United States Patent [19]

Masunaga et al.

[11] 4,070,297

[45] Jan. 24, 1978

[54] ELECTRICAL INSULATING OIL COMPOSITIONS

[75] Inventors: Midori Masunaga, Tokyo; Yoshiki Kohno, Kawasaki; Tadashi Ohmori, Yokohama, all of Japan

[73] Assignee: Nippon Oil Co., Ltd., Tokyo, Japan

[21] Appl. No.: 763,456

[22] Filed: Jan. 28, 1977

[30] Foreign Application Priority Data

Feb. 3, 1976 Japan ..... 51-10026

[51] Int. Cl.[2] ..... H01B 3/22

[52] U.S. Cl. ..... 252/63; 208/14

[58] Field of Search ..... 208/87, 211, 212, 213, 208/216, 96, 99, 14; 252/63

[56] References Cited

U.S. PATENT DOCUMENTS

| | | | |
|---|---|---|---|
| 3,617,473 | 11/1971 | Lipscomb | 208/14 |
| 3,627,673 | 12/1971 | Sproule et al. | 208/14 |
| 3,657,132 | 4/1972 | Gourlaouen et al. | 252/63 |
| 3,668,128 | 6/1972 | Anderson | 252/63 |
| 3,932,267 | 1/1976 | Lewis et al. | 208/14 |
| 4,008,148 | 2/1977 | Masunaga et al. | 208/211 |
| 4,033,854 | 7/1977 | Ohmori et al. | 208/14 |

*Primary Examiner*—Herbert Levine

*Attorney, Agent, or Firm*—Frank J. Jordan

[57] ABSTRACT

An electrical insulating oil composition having satisfactory oxidation stability, electrical properties and low-temperature performances, consisting essentially of (I) an electrical insulating oil having a sulphur content of 0.1–0.35 wt.% prepared from a paraffin or mixed base crude oil and (II) 0.001–1.0% by weight, based on said insulating oil, of an essentially amorphous ethylene-propylene copolymer having an average molecular weight of 10,000–200,000 and a propylene content of 10–70 mol%.

9 Claims, No Drawings

ELECTRICAL INSULATING OIL COMPOSITIONS

This invention relates to an electrical insulating oil composition consisting essentially of an electrical insulating oil specifically prepared from a paraffin or mixed base crude oil and incorporated with an ethylene-propylene copolymer. More particularly it relates to a novel electrical insulating oil composition having satisfactory oxidation stability, electrical properties, resistance to copper corrosion, and low-temperature performances prepared by adding 0.001–1.0% by weight of an essentially amorphous ethylene-propylene copolymer to an electrical insulating oil containing 0.1–0.35 wt.% of sulphur, the insulating oil being prepared by firstly treating a distillate containing at least 80 wt.% of a fraction having a boiling range of 230°–430° C at atmospheric pressure obtained by distilling a paraffin or mixed base crude oil at atmospheric pressure or distilling at a reduced pressure a bottom oil obtained by the distillation of the crude oil at atmospheric pressure, with a refining solvent capable of selectively dissolving aromatic compounds to remove 30–75 wt.% of the sulphur present in the said distillate thereby obtaining a raffinate, secondly hydrofining the thus obtained raffinate to remove 40–90 wt.% of the sulphur present in the raffinate, thirdly dewaxing the thus hydrofined oil with a solvent and, if desired, lastly treating the dewaxed oil with a solid absorbent to obtain the insulating oil containing 0.1–0.35 wt.% of sulphur.

There have heretofore been known many processes for the preparation of electrical insulating oils of mineral oil origin; however, conventional electrical insulating oils are practically prepared from naphthene base crude oils as the starting oil. Therefore, the conventional processes for preparing electrical insulating oils from the naphthene base crude oils are not suitable for use as processes for preparing satisfactory electrical insulating oils from the paraffin or mixed base crude oils.

Typical conventional processes for the preparation of an electrical insulating oil from the naphthene base crude oil, comprise the purification steps of washing with sulphuric acid, refining with a solvent or hydrofining and treating with a solid adsorbent to remove impurities such as unsaturated hydrocarbons, asphaltic substances, sulphur compounds and nitrogen compounds. If these purification steps are effected to such an extent that a low degree of purification is attained whereby improved copper corrosion resistance and electrical properties are not obtained on the resulting insulating oil, a high degree of purification will further be required. However, on one hand, such a high degree of purification will attain said improvement and, on the other hand, it will remove an unnecessarily large amount of the oxidation inhibiting ingredients naturally present in a mineral oil to be purified whereby it is generally impossible to produce an electrical insulating oil having satisfactory oxidation stability. Thus, there have been proposed processes for the preparation of electrical insulating oils having excellent electrical and oxidation stability which comprise incorporating a highly purified oil with a less highly one in a certain ratio (Japanese patent gazette Nos. 2981/60 and 3589/66 for example). In this manner, conventional electrical insulating oils have been produced from naphthene base crude oils of good quality as a starting oil. However, since the naphthene base crude oils of good quality have recently be in want anywhere in the world, it is intensively sought that electrical insulating oils be produced from paraffin or mixed base crude oils. Even if, on the other hand, it is attempted to obtain electrical insulating oils from the paraffin or mixed base crude oils by the use of the conventional processes for producing insulating oils from the naphthenic crude oils, there will not be obtained insulating oils having satisfactory oxidation stability, electrical properties, copper corrosion resistance and the like properties. This is a matter of course because the naphthene base crude oil is quite different in properties from the paraffin or mixed base crude oil. Therefore, it was necessary to find a novel process in order to produce thereby a satisfactory electrical insulating oil from the paraffin or mixed base crude oil.

Intensive studies had been made by the present inventors in an attempt to find such a novel process and, as a result of their studies, there was found a specific process which may produce an electrical insulating oil having excellent oxidation stability, electrical properties and copper corrosion resistance from the paraffin or mixed base crude oil. The novel process so found was applied for a patent under Japanese patent application No. 121521/74 (Japanese patent application laying-open gazette No. 48200/76), on which U.S. patent application Ser. No. 573575/75 now Pat. No. 4,008,148 is based.

The primary object of the present invention is to provide an electrical insulating oil composition remarkably improved in low-temperature properties (pour point, etc.) without impairing other useful properties by adding a small amount of the essentially amorphous ethylene-propylene copolymer to the electrical insulating oil produced from the paraffin or mixed base crude oil.

The paraffin base crude oil used herein is one containing paraffinic hydrocarbons in large proportions and more particularly the crude oil is such that its first key fraction (kerosene fraction) has an API specific gravity of not smaller than 40° and its second key fraction (lubricating oil fraction boiling at 275°–300° C at a reduced pressure of 40 mm of mercury) has an API specific gravity of not smaller than 30° as is described in "Sekiyu Binran (Handbook on Petroleum)" on page 19, 1972 edition published by Sekiyu Shunju Co., Ltd., Japan; typical of the paraffin base crude oils are a Pennsylvania crude oil, a Minas crude oil and the like. The mixed base crude oil used herein is one which is qualitatively intermediate between the paraffin and naphthene base crude oils and more particularly the mixed base crude oil is such that its first key fraction has an API specific gravity of 33°–40° and its second key fraction an API specific gravity of 20°–30°. Typical of the mixed base crude oils are Midcontinent crude oils and many of Middle East-produced crude oils such as Arabia and Khafji crude oils. In this invention there may preferably be used the Arabia crude oils such as Arabian medium and Arabian light crude oils.

The electrical insulating base oil used in this invention may be obtained as follows.

A distillate containing at least 80 wt.%, preferably at least 90 wt.% of a fraction having a boiling range of 230°–430° C, preferably 250°–400° C, the fraction being obtained by distilling a paraffin or mixed base crude oil at atmospheric pressure or by distilling at a reduced pressure a bottom oil obtained by the distillation of the crude oil at atmospheric pressure, is firstly treated with a refining solvent capable of selectively dissolving aromatic compounds thereby to remove 30–75 wt.% of the sulphur present in the distillate. The solvents for selectively dissolving the aromatic compounds therein are usual ones including furfural, liquid sulphur dioxide and phenol with furfural being particularly preferred. When furfural, for example, is used as the solvent, the extracting temperatures used may be in the range of 50°–100° C, preferably 60°–90° C, and the ratios by volume of furfural to the distillate or starting mineral oil may be in the range of 0.3–2.0, preferably 0.5–1.7. Then the raffinate obtained by the extraction of the starting distillate with the solvent is hydrofined to remove 40–90 wt.% of the sulphur present in the raffinate.

Catalysts which may be used in the hydrofining include the oxides of metals of Groups VI, IB and VIII of the Periodic Table, the metal oxide being supported by bauxite, activated carbon, Fuller's earth, diatomaceous earth, zeolite, silica, silica alumina or the like, as a carrier. These catalysts are usually used after preliminary sulphurization thereof. Typical of the metal oxides are cobalt oxide, molybdenum oxide, tungsten oxide and nickel oxide. In the practice of this invention there may particularly preferably be used a catalyst consisting of nickel and molybdenum oxides supported on an aluminum oxide-containing carrier, the metal oxides having been preliminarily sulphurized. The reaction temperatures in the hydrofining treatment may usually be in the range of about 230°– about 350° C, preferably 260°–320° C.

At lower reaction temperatures the reaction rate will be low, while at higher reaction temperatures the oil to be treated will be decomposed whereby the paraffin content is increased, the pour point is somewhat raised and the resulting hydrofined oil is not desirable in color. The reaction pressures may be at least 25 $kg/cm^2G$, preferably 25–100 $kg/cm^2G$, and more preferably 35–45 $kg/cm^2G$. In addition, the amounts of hydrogen contacted with the oil to be hydrofined may be in the range of 100–10,000 $Nm^3/Kl$ of oil, preferably 200–1,000 $Nm^3/Kl$ of oil.

The dewaxing with a suitable solvent is further effected to depress the pour point of the oil to be dewaxed. The solvent dewaxing according to this invention is to solidify the waxy substance in the oil for removal therefrom by the use of a known method which is usually the BK method in this case. The dewaxing solvents used herein include a mixed solvent such as a benzene-toluene-acetone or benzene-toluene-methyl ethyl ketone mixed solvent. The suitable composition (ratio of ketonic component to aromatic components) may preferably be in the range of about 30 – about 35% for the acetone-containing mixed solvent and about 45 – about 50% for the methyl ethyl ketone-containing mixed solvent. The ratios of the solvent to the oil being dewaxed may be such that the solvent-added oil fed to a dewaxing filter is maintained approximately constant in viscosity. The solvent dewaxing treatment according to this invention may be carried out at any stage, particularly preferably at a stage subsequent to the hydrofining step, in the process for the preparation of the electrical insulating oils. If necessary, the thus dewaxed oil may successively be treated with a suitable solid absorbent. The solid adsorbent treatment mentioned herein is intended to mean a finishing treatment for the preparation of a usual electrical insulating oil, by which treatment a mineral oil being treated is contacted with a solid adsorbent such as acid clay, Fuller's earth, alumina, silica alumina or activated clay at a temperature of usually about 30°–80° C preferably 50°–70° C, for about 0.5 to a few hours (one hour for example). The treating method employed is a percolation, contact or like method. The solid adsorbent treatment may alternatively be effected after incorporation of a predetermined amount of the essentially amorphous ethylene-propylene copolymer into the as-dewaxed oil.

This invention discloses an electrical insulating oil further improved in low-temperature properties by adding the essentially amorphous ethylene-propylene copolymer to the electrical insulating oil obtained from the paraffin or mixed base crude oil.

The electrical insulating oil of this invention has a depressed pour point by having been dewaxed with a solvent for dewaxing, as mentioned above. It is possible to depress the pour point of an electrical insulating oil to about −27.5° C at best by the use of a conventional dewaxing apparatus; JIS (Japanese Industrial Standard) C-2320 provides that the pour point shall not be higher than −27.5° C. In view of the use of the conventional dewaxing apparatus, it is economically desirable that the resulting dewaxed insulating oil should have a pour point of about −25° C at lowest.

This invention eliminates the aforesaid disadvantages and makes it possible to depress the pour point of electrical insulating oils easily and more economically without effecting a solvent dewaxing treatment under strict conditions. In other words, according to this invention, the addition of a small amount of the essentially amorphous ethylene-propylene copolymer to even electrical insulating oils obtained after the solvent dewaxing under mild dewaxing conditions, will result in the production of an end product having a pour point of not higher than −27.5° C or an end product having a very low pour point of as low as −40° C or lower which cannot be attained by the conventional solvent dewaxing process.

The pour point depressants which have heretofore been extensively used in the preparation of lubricating oils, are mostly polymethacrylates. However, these depressants when added to electrical insulating oils will have excellent pour point depressing effects on the electrical insulating oils and will simultaneously, as disadvantageous side effects, degrade them in water separability, emulsification resistance and electrical properties. They, particularly when used in electrical insulating oils, will remarkably degrade them in emulsification resistance, this rendering them unsuitable as a pour point depressant for the insulating oils.

This invention is further characterized by the fact that the incorporation of the essentially amorphous ethylene-propylene copolymer in the specified oil will depress the resulting electrical insulating oil in pour point without imparing its electrical properties, oxidation stability, emulsification resistance and other indispensable properties.

In the practice of this invention, it is desirable that the oil for the final electrical insulating oil be lowered to not higher than −15° C in pour point in view of economy of the solvent dewaxing treatment and the effect of the ethylene-propylene copolymer added. The use of an insulating oil having too high a pour point is undesirable since such an oil will require a larger amount of the ethylene-propylene copolymer added, thereby increasing the resulting insulating oil in viscosity and consequently lowering it in cooling effect which is an important characteristic of an electrical insulating oil.

The essentially amorphous ethylene-propylene copolymers according to this invention may be added to the insulating oil in an amount of 0.001–1.0%, preferably 0.01–0.2%, by weight of the insulating oil.

The amorphous ethylene-propylene copolymer is an oil-soluble one having a weight average molecular weight of 10,000–200,000, preferably 20,000–70,000 and a propylene content of 10–70 mol%, preferably 20–60 mol%. The term "amorphous copolymer" used herein is intended to mean an amorphous copolymer which has some degree of crystallization, usually 0–5% and preferably 0–2% of crystallization. Furthermore, the amorphous copolymer should preferably be one having such a relatively narrow distribution of molecular weight as usually not more than 8, particularly preferably not more than 4.

The ethylene-propylene copolymers according to this invention may be prepared by specific known processes. The polymerization for the preparation of the copolymers may be effected by introducing ethylene, propylene and hydrogen gas into a catalyst composition comprising an organic solvent soluble homogeneous Ziegler-Natta type catalyst and an inert organic solvent for dispersing the catalyst therein, at an atmospheric to somewhat elevated pressure (usually, about 1 to 20 kg/cm$^2$) and at low to somewhat elevated temperature (usually, about −50° to 50° C). Ethylene and propylene are different in polymerizing reaction rate from each other, and the reaction rate of ethylene is much higher than that of propylene; becuase of this, the monomeric ratio between ethylene and propylene used does not agree with that between the two contained in the resulting copolymer. It is therefore necessary to pay a careful attention to the monomeric ratio of ethylene to propylene used in order to obtain an ethylenepropylene copolymer having a desired propylene content.

The homogenizable Ziegler-Natta type catalysts which may preferably be used in the preparation of the specific copolymer according to this invention, include cooridination catalysts consisting of both a vanadium compound represented by the general formula $VO(OR)_nX_{3-n}$ wherein X is chlorine, bromine or iodine, R is a residue of hydrocarbons having 1–6 carbon atoms an n is an integer of 0–3, and an organoaluminum compound represented by the general formula $R_1AlX_2$, $R_1R_2AlX$, $R_1R_2R_3Al$ or $R_1R_2R_3Al_2X_3$ wherein $R_1$, $R_2$ and $R_3$ are a residue of hydrocarbons having 1–20, preferably 1–6, carbon atoms and may be different from, or identical with, each other. Typical of the organoaluminum compounds are triethyl aluminum, diethyl aluminum chloride, diisopropyl aluminum chloride and ethyl aluminum dichloride. The inert organic solvents usually used in the copolymerization include aliphatic and aromatic hydrocarbons with n-hexane, heptane, toluene, xylene and the like being preferred.

This invention will be better understood by the following non-limitative examples for illustration purposes only, in which examples all parts and percentages are by weight unless otherwise specified.

EXAMPLE 1 AND COMPARATIVE EXAMPLE 1

There was obtained a distillate (boiling range of 250°–400° C at atmospheric pressure, sulphur content of 2.0 wt. % by distilling a Middle East-produced (mixed base) crude oil at atmospheric pressure to recover a bottom oil and then distilling the thus recovered bottom oil at a reduced pressure. The distillate so obtained was extracted with furfural in the ratio by volume of 1.3 between the furfural and distillate at a temperature of 70°14 95° C to obtain a raffinate having a sulphur content of 0.8 wt.% (desulphurization ratio : 60 wt.%). The raffinate so obtained was then hydrofined in the presence of an NiO—$MoO_3$ catalyst (NiO : 3.0 wt.%; $MoO_3$ : 14.0 wt.%) carried on alumina, at a temperature of 300° C and a hydrogen pressure of 40 kg/cm$^2$G. The raffinate so hydrofined was dewaxed with a benzene-toluene-methyl ethyl ketone mixed solvent in the solvent ratio of 1.6 between the solvent and the hydrofined raffinate and at a cooling temperature of −30° C, thereby obtaining a base oil having a pour point of −27.5° C and sulphur content of 0.16 wt.%. The insulating base oil so obtained was incorporated with 0.1 wt.% of an essentially amorphous ethylene-propylene copolymer having a weight average molecular weight of 40,000 and a propylene content of 37.5 mol% thereby to obtain a novel electrical insulating oil composition of this invention the properties of which are shown in Table 1.

For comparison, the insulating base oil as obtained in Example 1 was incorporated with 0.5 wt.% of a polymethacrylate which was a commercially available pour point depressant, thereby obtaining a comparative electrical insulating oil the properties of which are also shown in Table 1.

It is seen from Table 1 that the comparative insulating oil and the novel one have the same depressed pour point and that the comparative oil is inferior to the insulating base oil in emulsification resistance and electrical properties, while the novel insulating oil is equal to the insulating base oil in oxidation stability, emulsification resistance and electrical properties. This indicates that the novel insulating oil is an excellent electrical insulating oil.

Table 1

| | | Insulating base oil | Novel insulating oil | Comparative insulating oil |
|---|---|---|---|---|
| Pour point ° C | | −27.5 | −45 | −45 |
| Oxidation stability (JIS C-2101) | Sludge % | 0.15 | 0.14 | 0.15 |
| | Acid value mgKOH/g | 0.38 | 0.36 | 0.41 |
| Steam emulsion number (JIS K-2517) sec | | 33 | 35 | at least 1200 |
| Volume resistivity 80° C, Ω-cm | | $5.1\times10^{15}$ | $4.3\times10^{15}$ | $6.8\times10^{14}$ |
| Dielectric tangent 80° C, % | | 0.005 | 0.008 | 0.023 |

EXAMPLE 2

There was obtained a distillate (boiling range of 270°–380° C at atmospheric pressure, sulphur content 2.0 wt.) by distilling an Arabian medium crude oil at atmospheric pressure to recover a bottom oil and then distilling the thus recovered bottom oil at a reduced pressure. The distillate so obtained was then extracted with furfural in the ratio by volume of 1.0 between the furfural and distillate at a temperature of 65°–90° C to obtain a raffinate having a sulphur content of 0.90 wt.% (desulphurization ratio : 55 wt. %). The raffinate so obtained was hydrofined at a temperature of 305° C and a hydrogen pressure of 40 kg/cm$^2$G in the presence of the same catalyst as used in Example 1. Two portions of the raffinate so hydrofined were then solvent dewaxed in the same manner as in Example 1 except that the cooling temperatures used for the two portions were −20° C and −25° C, respectively. The thus dewaxed two portions were successively treated with activated clay at 70° C for 1 hour to obtain insulating base oils A and B, respectively. Portions of the insulating base oils A and B were incorporated with an amorphous ethylene-propylene copolymer having a weight average molecular weight of 30,000 and a propylene content of 50 mol% in accordance with the formulations as indicated in Table 2 thereby to obtain novel electrical insulating oils the properties of which are also indicated in said Table.

As is apparent from Table 2, The ethylene-propylene copolymer will have an excellent depressing effect on the pour point of the insulating base oils prepared from Middle East-produced crude oils according to this invention when the copolymer is added to the insulating base oils. From the Table, it is also apparent that the copolymer-added base oils are electrical insulating oils which are excellent in oxidation stability, electrical properties, emulsification resistance and the like.

Table 2

| | Insulating base oil A Amount of ethylene-propylene copolymer added | | Insulating base oil B Amount of ethylene-propylene copolymer added | | | |
|---|---|---|---|---|---|---|
| | None | 0.05 wt. % | None | 0.02 wt. % | 0.05 wt. % | 0.1 wt. % |
| Pour point ° C | −17.5 | −27.5 | −22.5 | −27.5 | −35 | −40 |
| Oxidation stability (JIS C-2101) Sludge % | 0.11 | 0.12 | 0.10 | — | — | 0.12 |
| Oxidation stability (JIS C-2101) Acid value mgKOH/g | 0.33 | 0.34 | 0.29 | — | — | 0.29 |
| Steam emulsion number sec (JIS K-2517) | 28 | 30 | 35 | — | — | 34 |
| Volume resistivity 80° C, Ω-cm | $38\times10^{15}$ | $39\times10^{15}$ | $42\times10^{15}$ | — | —. $37\times10^{15}$ | |
| Dielectric loss tangent 80° C, % | 0.006 | 0.005 | 0.005 | — | — | 0.007 |

What is claimed is:

1. An electrical insulating oil composition having satisfactory oxidation stability, electrical properties and low-temperature performances, consisting essentially of:

I an electrical insulating oil having a sulphur content of 0.1–0.35 wt.% prepared by firstly refining a distillate containing at least 80 wt.% of a fraction having a boiling range of 230°–430° C at atmospheric pressure and being obtained by the distillation of a paraffin or mixed base crude oil at atmospheric pressure or by the distillation at a reduced pressure a bottom oil obtained by the distillation of the crude oil at atmospheric pressure, with a refining solvent for selectively dissolving aromatic compounds therein to remove 30–75 wt. of the sulphur present in the said distillate thereby obtaining a raffinate, secondly hydrofining the thus obtained raffinate to remove 40–90 wt.% of the sulphur present in the raffinate, thirdly dewaxing the hydrofined oil with a dewaxing solvent to obtain the electrical insulating oil and II 0.001–1.0% by weight, based on the oil (I), of an essentially amorphous ethylene-propylene copolymer having an average molecular weight of 10,000–200,000 and a propylene content of 10–70 mol%.

2. An electrical insulating oil composition according to claim 1, wherein the hydrofined oil is further treated with a solid adsorbent subsequent to the solvent dewaxing.

3. An electrical insulating oil composition according to claim 1, wherein the refining solvent is a member selected from the group consisting of furfural, liquid sulphur dioxide and phenol.

4. An electrical insulating oil composition according to claim 1, wherein the hydrofining is effected at a temperature of about 230°–about 350° C and a pressure of at least 25 kg/cm$^2$G in the presence of a catalyst selected from the group consisting of the oxides of metals of Groups VI, IB and VIII, the catalyst being supported on a carrier selected from the group consisting of bauxite, activated carbon, Fuller's earth, diatomaceous earth, zeolite, alumina, silica and silica alumina.

5. An electrical insulating oil composition according to claim 1, wherein the dewaxing solvent is a member selected from the group consisting of a benzene-toluene-acetone mixed solvent and a benzene-toluene-methyl ethyl ketone mixed solvent.

6. An electrical insulating oil composition according to claim 2, wherein the solid adsorbent is a member selected from the group consisting of acid clay, activated clay, Fuller's earth, alumina and silica alumina.

7. An electrical insulating oil according to claim 2, wherein the refining solvent is a member selected from the group consisting of furfural, liquid sulphur dioxide and phenol.

8. An electrical insulating oil composition according to claim 2, wherein the hydrofining is effected at a temperature of 230°–350° C and a pressure of at least 25 kg/cm$^2$G in the presence of a catalyst selected from the group consisting of the oxides of metals of Groups VI, IB and VIII, the catalyst being supported on a carrier selected from the group consisting of bauxite, activated carbon, Fuller's earth, diatomaceous earth, zeolite, alumina, silica and silica alumina.

9. An electrical insulating oil composition according to claim 2, wherein the dewaxing solvent is a member selected from the group consisting of a benzene-toluene-acetone mixed solvent and a benzene-toluene-methyl ethyl ketone mixed solvent.

* * * * *